US006584742B1

(12) United States Patent
Kligler et al.

(10) Patent No.: US 6,584,742 B1
(45) Date of Patent: Jul. 1, 2003

(54) ORIENTED STRAND BOARD WALL PANEL SYSTEM

(75) Inventors: Lennard J. Kligler, West Palm Beach, FL (US); Paul Murphy, Royal Palm Beach, FL (US); Wolfgang Unger, New Smyrna Beach, FL (US); Bruce Harrington, Jupiter, FL (US)

(73) Assignee: Structural Technologies, Inc., West Palm Beach, FL (US)

( * ) Notice: Subject to any disclaimer, the term of this patent is extended or adjusted under 35 U.S.C. 154(b) by 0 days.

(21) Appl. No.: 09/573,796

(22) Filed: May 16, 2000

(Under 37 CFR 1.47)

Related U.S. Application Data

(63) Continuation-in-part of application No. 08/884,514, filed on Jun. 27, 1997, now abandoned.

(51) Int. Cl.[7] ..... E04C 1/00
(52) U.S. Cl. ..... 52/309.7; 52/309.8; 52/241
(58) Field of Search ..... 52/309.11, 309.7–309.9, 52/783.1, 241, 668, 455

(56) References Cited

U.S. PATENT DOCUMENTS

| | | | | | |
|---|---|---|---|---|---|
| 3,643,394 | A | * | 2/1972 | Johnson | 52/309 |
| 3,965,635 | A | * | 6/1976 | Renkert | 52/434 |
| 4,148,157 | A | * | 4/1979 | Franc | 49/501 |
| 4,163,349 | A | | 8/1979 | Smith | 52/241 |
| 4,238,266 | A | * | 12/1980 | Steinberg et al. | 156/243 |
| 4,578,909 | A | | 4/1986 | Henley et al. | 52/90 |
| 4,765,105 | A | | 8/1988 | Tissington et al. | 52/309.11 |
| 5,157,892 | A | | 10/1992 | Ryther | 52/785 |
| 5,269,109 | A | | 12/1993 | Gulur | 52/309.9 |
| 5,404,685 | A | | 4/1995 | Collins | 52/309.7 |
| 5,433,050 | A | | 7/1995 | Wilson et al. | 52/302.1 |
| 5,443,894 | A | * | 8/1995 | Pollack et al. | 428/213 |
| 5,519,971 | A | | 5/1996 | Ramirez | 52/220.2 |
| 5,540,026 | A | | 7/1996 | Gartland | 52/455 |
| 5,617,700 | A | | 4/1997 | Wright et al. | 52/793.1 |
| 5,901,524 | A | | 5/1999 | Wright | 52/668 |

OTHER PUBLICATIONS

Carolina Skiff, "Carolina Skiff Sea Chaser", Apr. 2000, Carolina Skiff Advertising Dept House Design; Website.

* cited by examiner

*Primary Examiner*—Carl D. Friedman
*Assistant Examiner*—Naoko Slack
(74) *Attorney, Agent, or Firm*—Fish & Richardson P.C.

(57) ABSTRACT

A wall panel includes an outer surface layer, an oriented strand board layer, and mounting channels. The outer surface layer includes an outer surface, an inner surface, and edges. The oriented strand board layer includes an outer surface, an inner surface, and edges, with the outer surface of the oriented strand board layer being attached to the inner surface of the outer surface layer. The mounting channels are defined along and between the edges of the outer surface layer and the oriented strand board layer, and define a region recessed from the edges of the outer surface layer and the oriented strand board layer.

27 Claims, 9 Drawing Sheets

ORIENTED STRAND BOARD WALL PANEL SYSTEM

CROSS-REFERENCE TO RELATED APPLICATIONS

This application is a continuation-in-part of U.S. application Ser. No. 08/884,514, filed Jun. 27, 1997, now abandoned which is incorporated herein by reference in its entirety.

TECHNICAL FIELD

The invention relates to wall panels that include oriented strand boards.

BACKGROUND

It is known that significant structural integrity may be achieved by attaching a piece of thin rigid board (e.g., plywood) on each side of a foam board (e.g., polystyrene) in a sandwich form. While the individual materials may possess little, if any, load bearing strength, the panel formed by laminating them together may provide greater load bearing strength than conventional wood or metal framing.

Known building panels based on this theory include a polystyrene or polyurethane core and oriented strand board or light gauge metal skins. Panels having metal skins are used primarily in commercial and industrial construction to enclose buildings such as warehouses, manufacturing facilities, offices and retail structures. The panels with oriented strand board skins, which also are known as structural insulated panels, are used primarily to form exterior walls and roofs of residential dwellings. In addition, curtain panels for office and other buildings have been produced using foam board attached over lightweight metal framing and covered with layers of synthetic stucco and fabric mesh, or panels pre-cast from concrete and having marble or other decorative stone attached to their surfaces.

SUMMARY

In one general aspect, a wall panel includes an outer skin surface layer, an oriented strand board, and mounting channels. The outer surface layer includes an outer surface, an inner surface, and edges. The oriented strand board layer includes an outer surface, an inner surface, and edges, with the outer surface of the oriented strand board layer attached to the inner surface of the outer surface layer. The mounting channels are defined along and between the edges of the outer surface layer and the oriented strand board layer, and define a region recessed from the edges of the outer surface layer and the oriented strand board layer.

Embodiments of the wall panel may include one or more of the following features. For example, the outer surface layer may include an outer gel coat layer and an inner skin layer, and the outer gel coat layer may include a gel coat material, such as a white gel coat material. The gel coat material may further comprise a dye. The outer gel coat layer may include a textured outer surface, such as a marble texture, a stone texture, a brick texture, and/or a wood texture.

The inner skin layer may include glass fiber and resin. The glass fiber may be provided in a range of between approximately 2.0 and 5.0 ounces of glass fiber per square foot and the resin may be provided in a range of between approximately 6.0 and 14.0 ounces of resin per square foot.

The outer layer may further include a reinforcing layer adjacent to the oriented strand board layer. The reinforcing layer may include glass fibers and resin. The reinforcing layer also may include at least one reinforcing rib. The reinforcing layer may be generally L-shaped, and include a length section and a width section. A length of the oriented strand board layer may be adjacent to the length section of the reinforcing layer and a width of the oriented strand board layer may be adjacent to the width section of the reinforcing layer.

The wall panel may further include a second skin layer, which is adjacent to the oriented strand board layer. The second skin layer may include glass fiber and resin, and may be textured similarly to the gel coat layer. The mounting channel may be generally C-shaped, and may be made of metal.

In another general aspect, a method of making a wall panel includes providing a mold, dispensing a gel coat material into the mold to form a gel coat layer, dispensing glass fiber and resin above the gel coat layer to form an inner skin layer that is attached to the gel coat layer, attaching mounting channels around and to a periphery of the gel coat layer and inner skin layer, attaching a reinforcing layer to the wall panel in a position above the inner skin layer and between the mounting channels, and attaching an oriented stand board layer to the reinforcing layer.

Embodiments of the method of making a wall panel may include one or more of the following features. For example, the method may include heating the gel coat layer prior to dispensing the glass fiber and resin.

The method may also include placing a heated cover over the mold, applying heat and a vacuum to the mold to cure the materials in the mold, and removing the heated cover when the materials are cured. The method also may include dispensing glass fiber and resin above the oriented strand board layer to form a second skin layer.

In another general aspect, a method of constructing a wall includes securing a horizontal mount to a floor, providing a wall panel, and mounting the wall panel to the horizontal mount. The horizontal mount has a cross-section that corresponds in shape to a mounting channel recessed in the wall panel. The wall panel includes a gel coat layer, an outer skin layer, a reinforcing layer, a layer of oriented strand board, and the mounting channel.

Embodiments of the method of making a wall panel may include one or more of the following features. For example, the wall panel may further include a second skin layer that is adjacent to the oriented strand board layer. Mounting the wall panel to the horizontal mount may further include applying a fusion monomer to fix the wall panel to the horizontal mount. The method may further include mounting an upper mounting channel of the wall panel to a second mount, which is attached to a vertical column. The method may further include mounting a second wall panel to the second mount.

Advantages of the wall panels include reduced construction time and construction costs because the panels are complete with finished texture and color. Textures such as those resembling marble, brick, wood, or slate may be provided at costs that are substantially less than costs associated with actually using those materials. The panels also have improved durability because the composite materials are impervious to essentially all environmental conditions, as well as superior energy efficiency resulting from the oriented strand board inner insulative layer.

Other features and advantages of the invention will be apparent from the following detailed description, including the drawings, and from the claims.

DESCRIPTION

Figure 1:
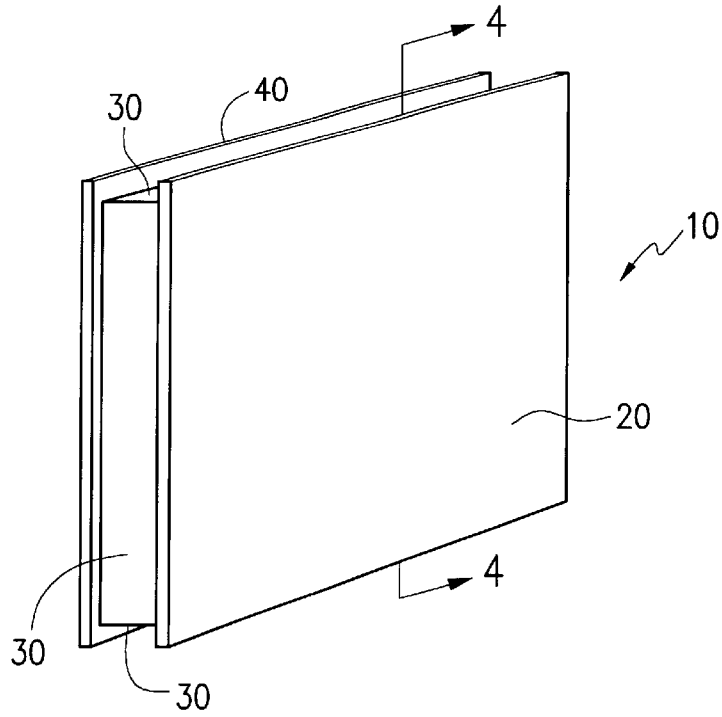
FIGS. 1 and 2 are perspective views of an oriented strand board ("OSB") wall panel.
Figure 2:
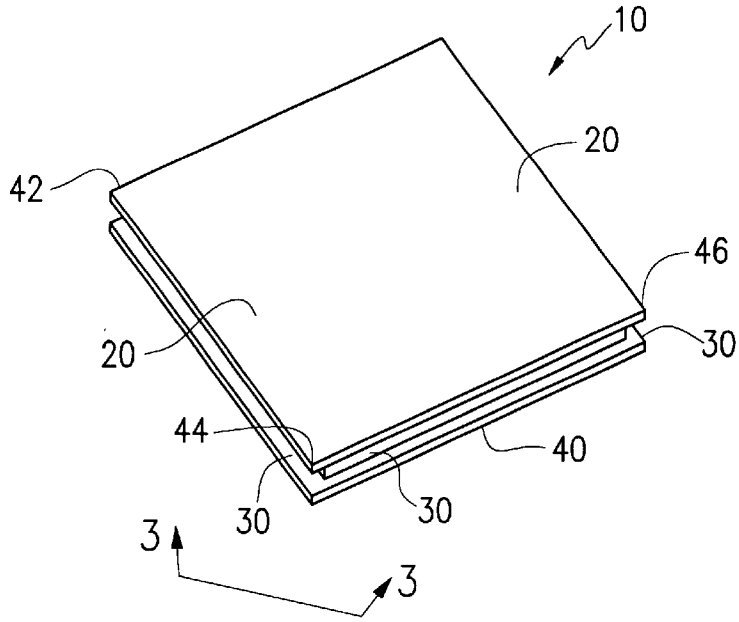
Figure 3:
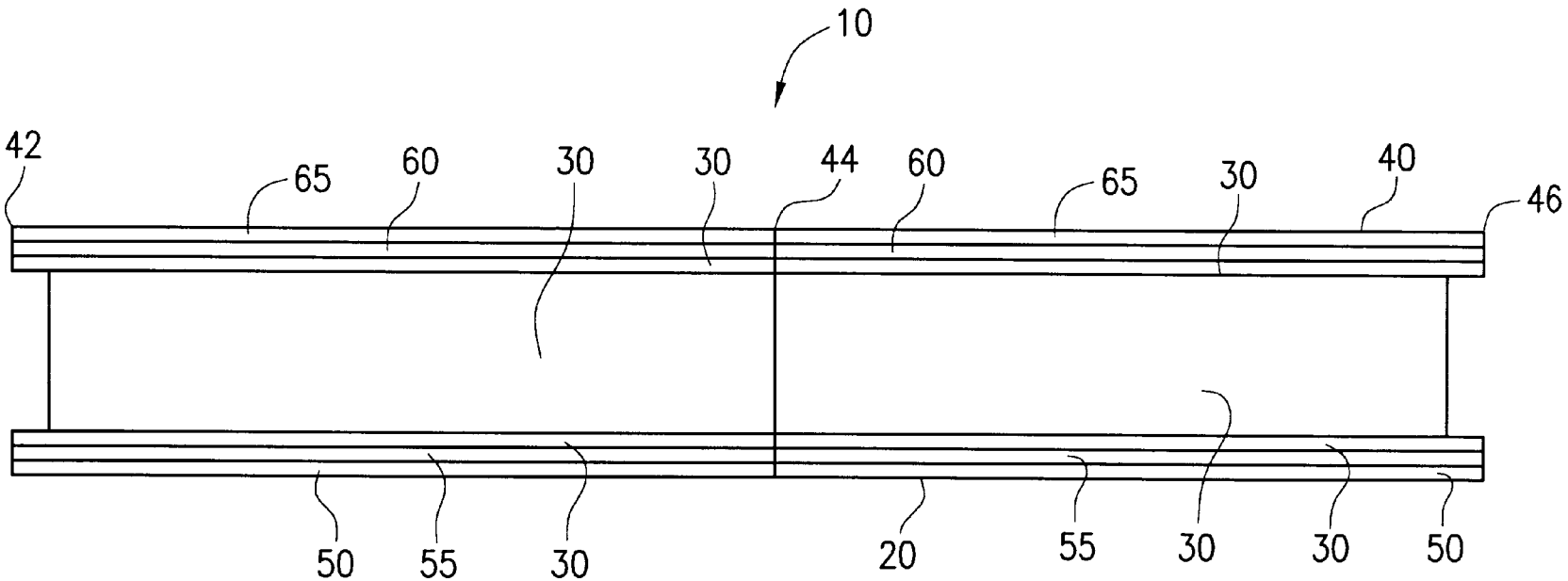
FIG. 3 is a front view of the OSB wall panel taken along section line 3—3 of FIG. 2.

Referring to FIGS. 1 and 2, an oriented strand board ("OSB") wall panel 10 includes an outer surface 20, C-channels 30 positioned around the periphery of the panel 10, and an inner surface 40. As illustrated in FIG. 3, which is a side view of the panel 10 of FIGS. 1 and 2 showing corners 42, 44, and 46, the C-channels 30 are recessed around the panel's periphery.

Figure 4:
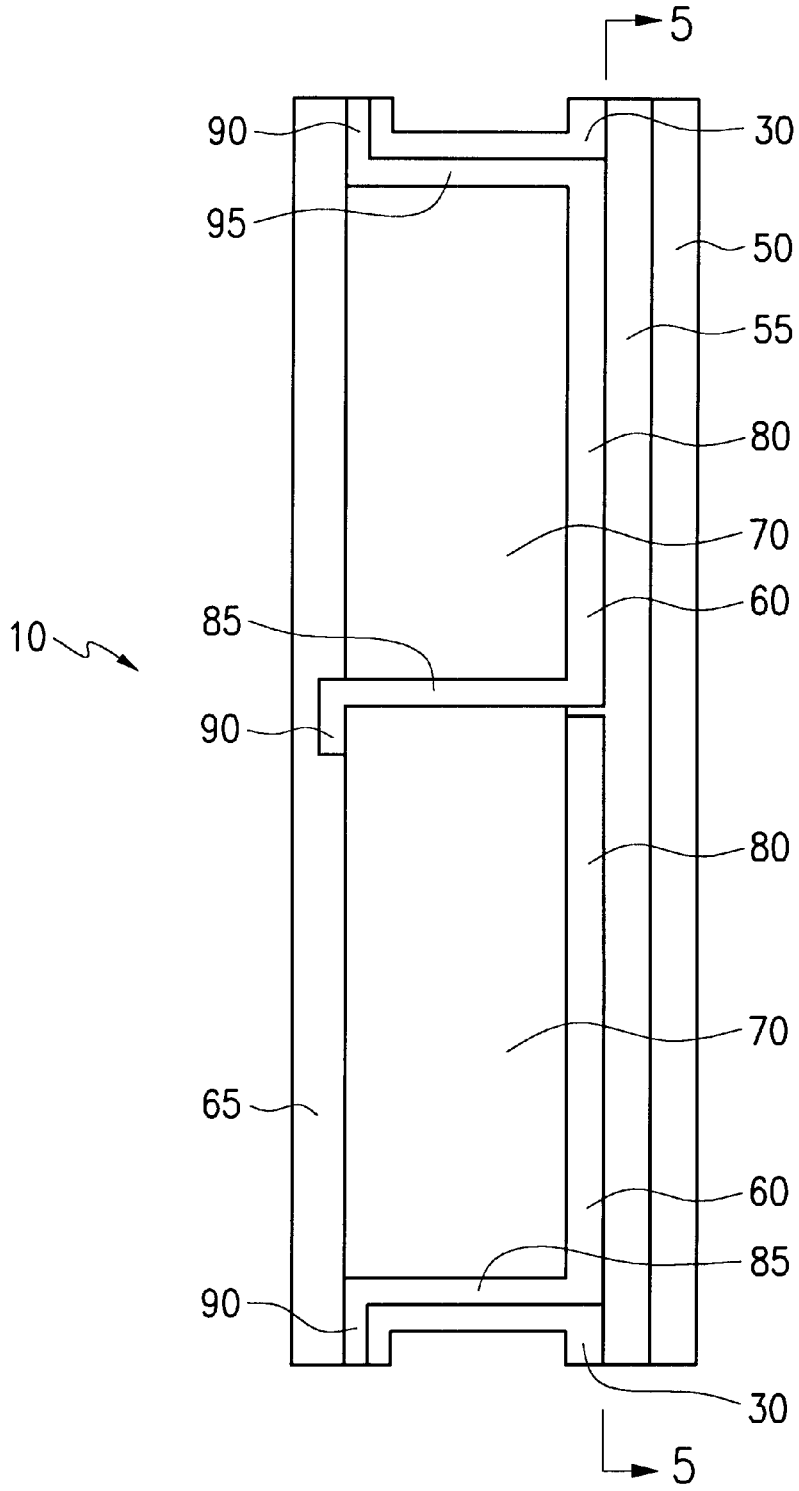
FIG. 4 is a cross-sectional side view of the OSB wall panel taken along section line 4—4 of FIG. 1.

As seen also in FIG. 4, the outer surface 20 includes a gel coat layer 50, an outer skin layer 55, and a generally L-shaped reinforcement layer 60. The inner surface 40 includes an inner, second skin layer 65 and a segment of the reinforcement layer 60. OSB insulation panels 70 are positioned within a volume defined by the L-shaped reinforcement layer 60, such that they are parallel to the inner surface 40 and the outer surface 20. Generally, each reinforcement layer 60 includes a length section 80, a width section 85, and an overlap section 90. One implementation of the layer 60 includes a second width section 95.

Figure 5:
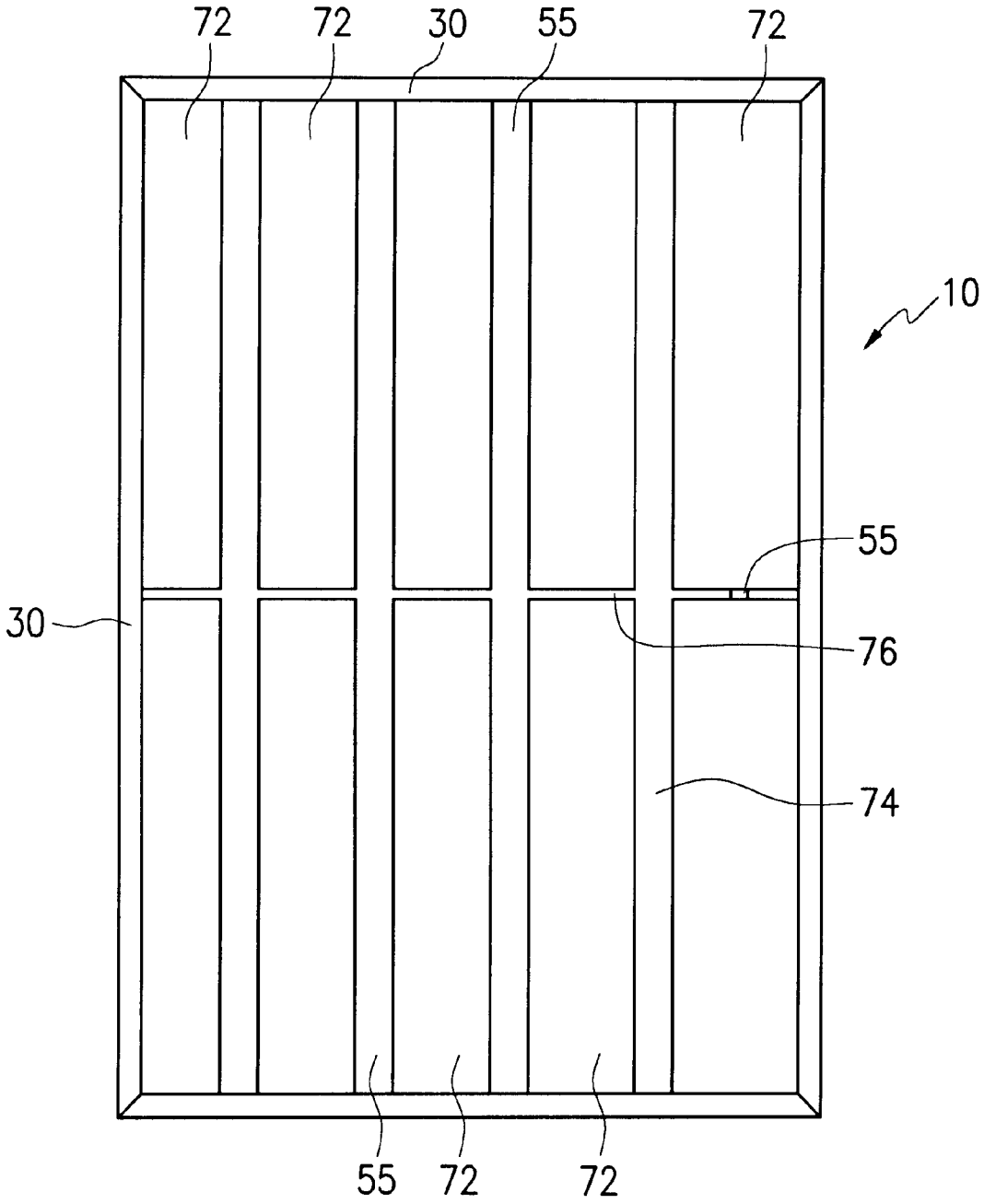
FIG. 5 is a cross-sectional top view of the OSB wall panel taken along section line 5—5 of FIG. 4.

FIG. 5 shows a sectional view of the OSB wall panel 10 taken at a level between the reinforcement layer 60 and the outer skin layer 55; The reinforcement layer 60 consists of individual ribs 72 that run lengthwise along the vertical length of the panel 10. A vertical space 74 and a horizontal space 76 is formed between each pair of individual ribs 72. The outer skin layer 55 fills in the spaces 74 and 76. The width and length of the individual ribs, and the number of ribs used, can be varied. For example, the wall panel 10 may include many slender ribs with a relatively large vertical space 74 between each rib. The ribs instead may be relatively wide, as illustrated in FIG. 5, with the vertical spaces 74 being relatively narrow. The reinforcement layer 60 typically will consist of a two vertical layers of ribs 72., with one layer being positioned above the other layer, as illustrated in FIGS. 4 and 5.

Figure 6:
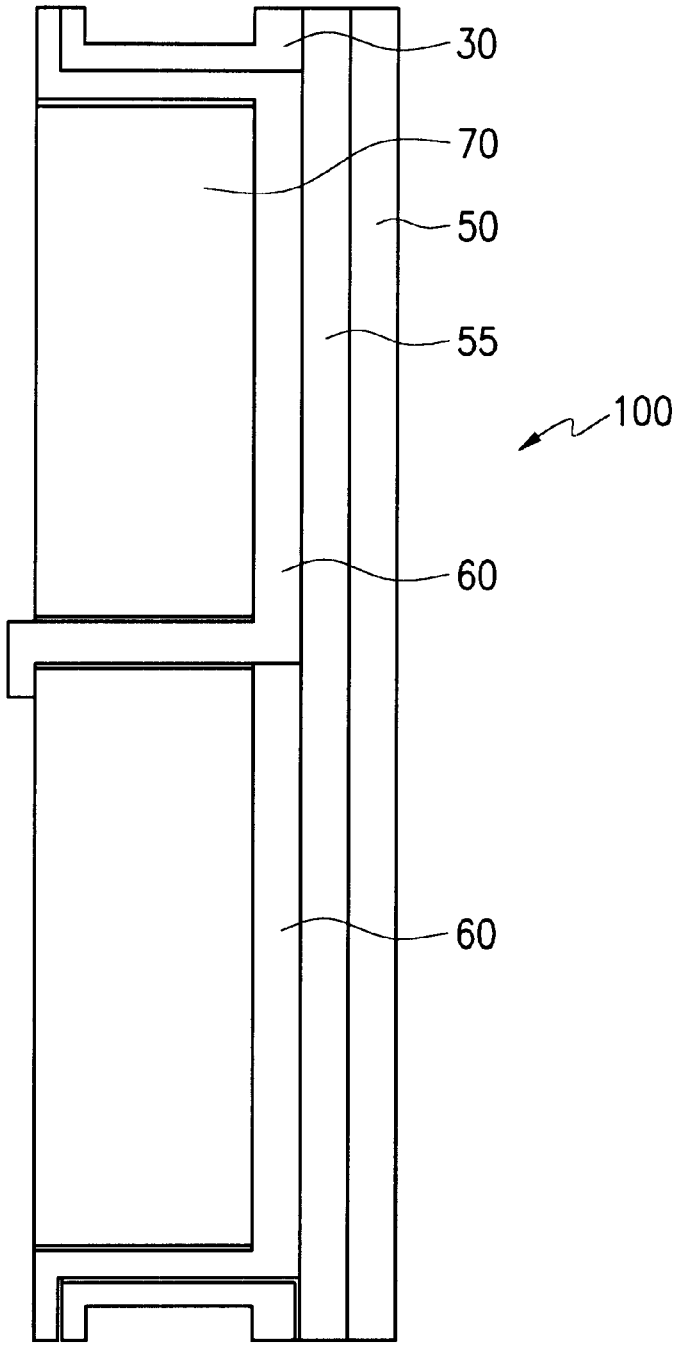
FIG. 6 is across-sectional side view of an OSB wall panel without an inner skin layer.

Referring also to FIG. 6, a modified, OSB wall panel 100 differs from the OSB wall panel 10 in that the panel 100 lacks the inner, second skin layer 65 of the panel 10. The OSB wall panel 100 is used, for example, where there is less of a strength requirement or where dry wall is to be attached to the inner surface 40 and the properties provided by the skin layer 65 are not necessary.

Referring again to FIG. 4, the gel coat layer 50 is fabricated from a gel coat material such as White Gel Coat sold under the trade name White PL 156-42 by Ferro Corporation of Plymouth, Ind., and/or P540 NPG Gel Coat sold by Inter-Plastics Corporation, Corex Division, of Vadnais Heights, Minn. The gel coat material may be colored with a dye to provide an attractive appearance to the outside of the wall panels 10 and 100. The gel coat also may be textured to give a desired surface appearance. Typically, the gel coat is approximately 12 thousands to 20 thousands of an inch in thickness. Although not shown in FIG. 4, the gel coat material can be applied to the inner skin layer 65 if desired for aesthetic purposes.

Outer skin layer 55 and inner skin layer 65 are fabricated from a mixture of filled resin and fiber, such as chopped glass fiber. The filled resin may be, for example, a polyester resin sold under the trade name 144-17 Polyester Resin by AOC of Lakeland, Fla., and/or a polyester resin sold under the trade name 32-487-00 Polyester Resin by Reichold Chemical of Research Triangle Park, N.C. The resin may be filled with one or more of Value Fill 650 calcium sulfate sold by Allied Custon Gypsum of Lindsay, Okla.; Fillite 500 ceramic microspheres sold by Telleborg Fillers, Inc. of Norcross, Ga.; and Expancel 551 DE plastic microspheres sold by Expancel, Inc. of Marietta, Ga. The fiber may be, for example, glass fiber sold under the trade name 352 Continuous Strand Routing by Owens Corning of Toledo, Ohio, and/or 292-207 Continuous Strand Routing by Vetrotex America of Wichita Falls, Tex. The outer skin layer 55 provides strength to the wall panel 10. For example, to make the wall panel 10 the amount of resin and fiber per square foot may be provided in a range of approximately 6 to 14 ounces and 2.0 to 5.0 ounces, respectively. To make the wall panel 10 for one application, the amount of resin and fiber per square foot may be approximately 13 ounces and 4.5 ounces, respectively. If the wall panel 10, or the outer skin layer 55 does not need to be as strong in another application, less material per square foot is necessary, and the materials may be provided, for example, at 6.5 ounces of resin and 2.25 ounces of fiber per square foot. Typically, the inner skin layer 65 does not need to be as strong as the outer skin layer 55, and, accordingly, less resin and fiber are used in its construction. The texturing of the outer surface is provided based on the surface characteristics of a mold used during fabrication of the panel, as described in more detail below. Thus, the skin layers 55 and 65 will be textured if the gel coat layer is textured.

The C-channels 30 function as mounting channels to construct a wall from individual wall panels and to provide structural support, and typically are made from steel channels. Other shapes of the channels 30 are possible, depending upon structural considerations, such as the shape of the structure to which the panels will be mounted. The reinforcement layer 60 typically is made of glass fiber and resin, and may be in the form of a sheet or ribs 72. Layer 60 may be implemented in a variety of forms as described above, but typically will include the longitudinal section 80, the width section 85, and the overlap section 90. Adjacent width sections 85 and 95 surround the OSB insulation layer 70. Overlap sections 90 surround C-channels 30 and/or the OSB insulation layer 70. Although FIGS. 4–6 show only two vertical reinforcement layers 60 and two vertical OSB insulation layers 70, additional reinforcement layers 60 and insulation layers 70 may be included to make a longer panel. Also, other composite materials may be used if they provide adequate structural support to the wall panel.

Insulation layer 70 is fabricated from a material with sound and thermal insulative properties, such as, OSB, polyurethane and polystyrene. Oriented strand board typically is available in sheet form and consists of a layer of oriented strands adhered together with an adhesive and encased by a paper layer on the outer surfaces. Alternatively, the insulation layer 70 may be cast and cured, and used in sheet form to fabricate wall panels 10 and 100.

Figure 7:
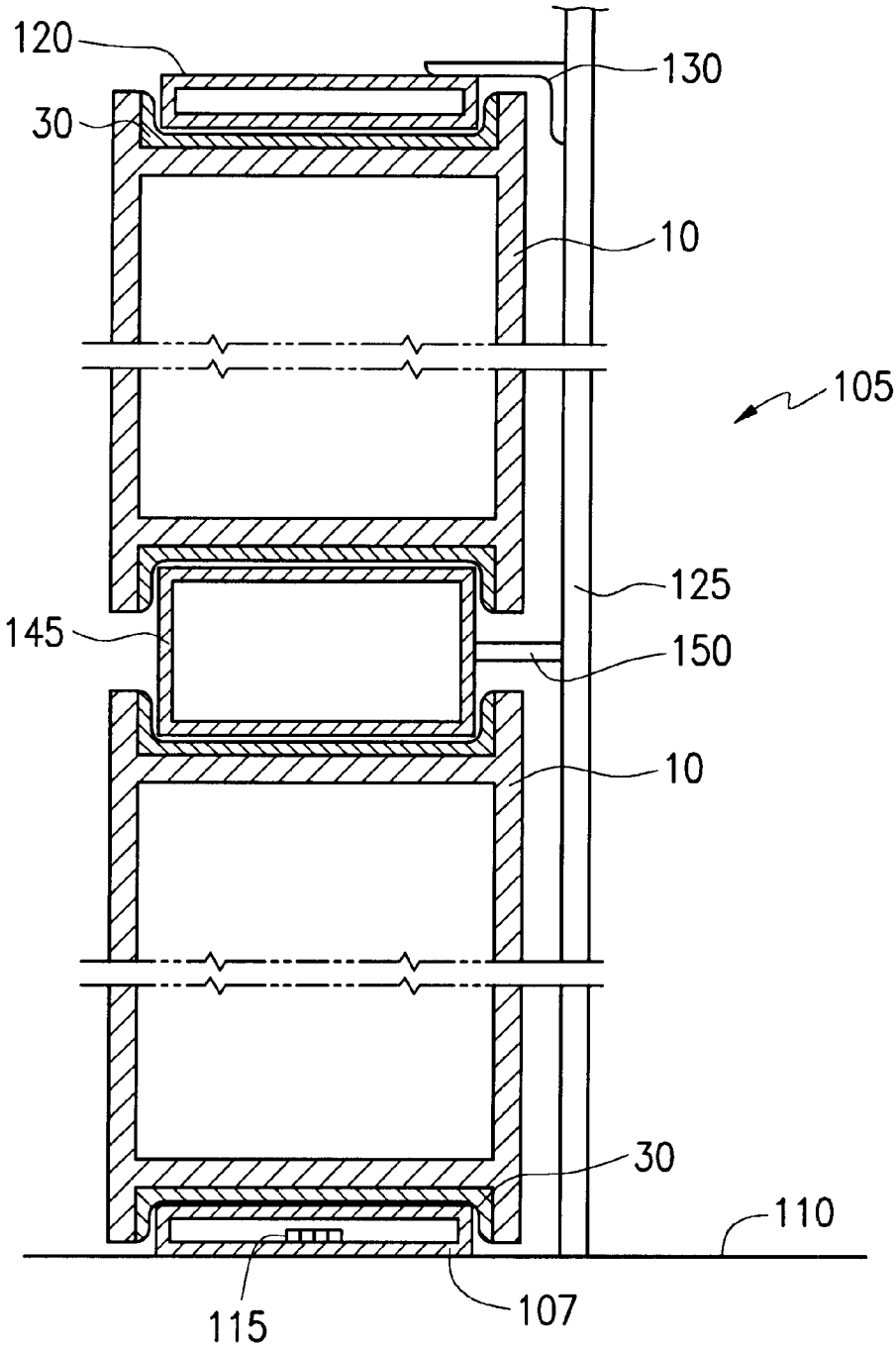
FIG. 7 is a cross-sectional side view of a wall constructed with the OSB wall panel of FIG. 1.

Referring to FIG. 7, a wall 105 constructed with the OSB wall panels 10 includes a rectangular steel tube 107 mounted to a foundation or floor 110 of a building using a steel bolt 115. The C-channel 30 of wall panel 10 is mounted around the rectangular steel tube 107 using a fusion monomer, such as a polyester resin sold under the trade name 144-17 polyester resin by AOC of Lakeland, Fla., and/or a polyester resin sold under the trade name 32-487-00 Polyester Resin by Reichold Chemical of Research Triangle Park, N.C. A rectangular steel tube 120 is mounted to the top C-channel 30 of second wall panel 10 using the fusion monomer. The steel tube 120 is attached to a column 125 by an angled rod 130 welded to the tube 120 and column 125. The angled rod 130 may be, for example, steel, and may be welded and/or bolted to the column and tube 120. The angled rod 130 also may be made of other materials, such as a high strength polymer, aluminum, or other material suitable for mounting the tube 120 to the column 125.

A horizontal panel tube 145 is positioned between the two wall panels 10 and is attached to column 125 by a straight rod 150. The rod 150 may be made from a material such as steel, aluminum, or a high strength polymer, and may be attached to the column 125 and panel tube 145 using any appropriate attachment means, including welding, bolting, or application of an adhesive or a fusion monomer. The steel tubes 107 and 120, and the panel tube 145 may have any shape that will mate with the channels 30. The channels 30 also may have any shape that will mate with the mounting tubes to which the panels are mounted.

Figure 8:
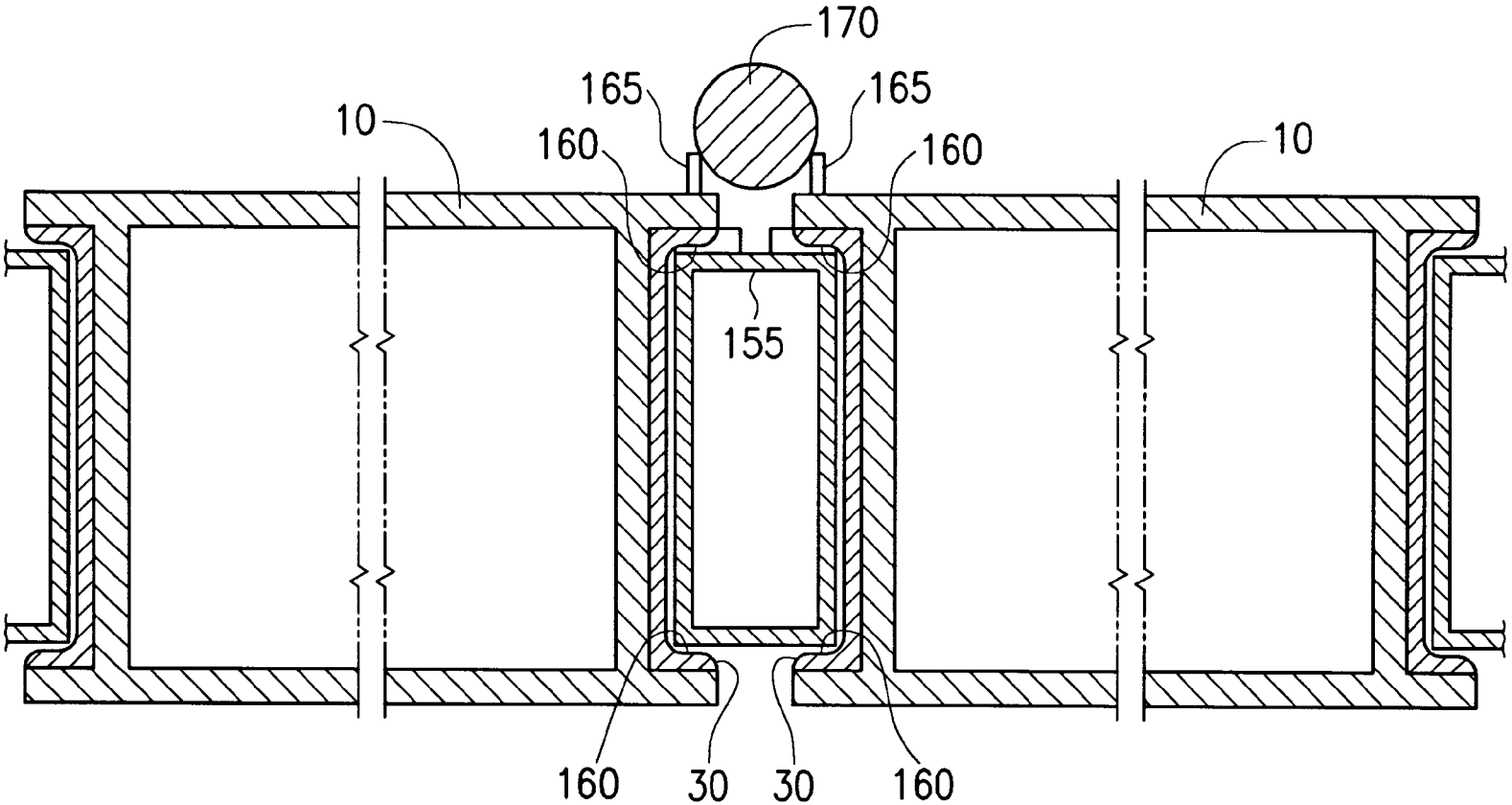
FIG. 8 is a cross-sectional top view of a wall constructed with the OSB wall panel of FIG. 1.

Referring to FIG. 8, the OSB wall panels 10 may have one or more vertical panel tubes 155 that fit within adjacent horizontal C-channels 30 of adjacent wall panels 10. Parallel edges 160 of the C-channel 30 surround the panel tubes 155. Brackets 165 are used to attach the vertical panel tubes 155 to a vertical column 170 adjacent to the wall panels. The brackets 165 may be made of a metal, such as steel or aluminum, which is welded or bolted to the tube 155. The brackets also may be made of a polymer, and attached to the column using, for example, an adhesive or fusion monomer. If the vertical panel tubes 155 are placed between each pair of adjacent horizontal C-channels and attached to the column 170, the wall panels 10 then will be slidable in the vertical direction but fixed in the horizontal and lateral directions. A wall may be formed using a combination of the horizontal panel tubes 145 and the vertical panel tubes 155 to provide a solid wall.

Figure 9:
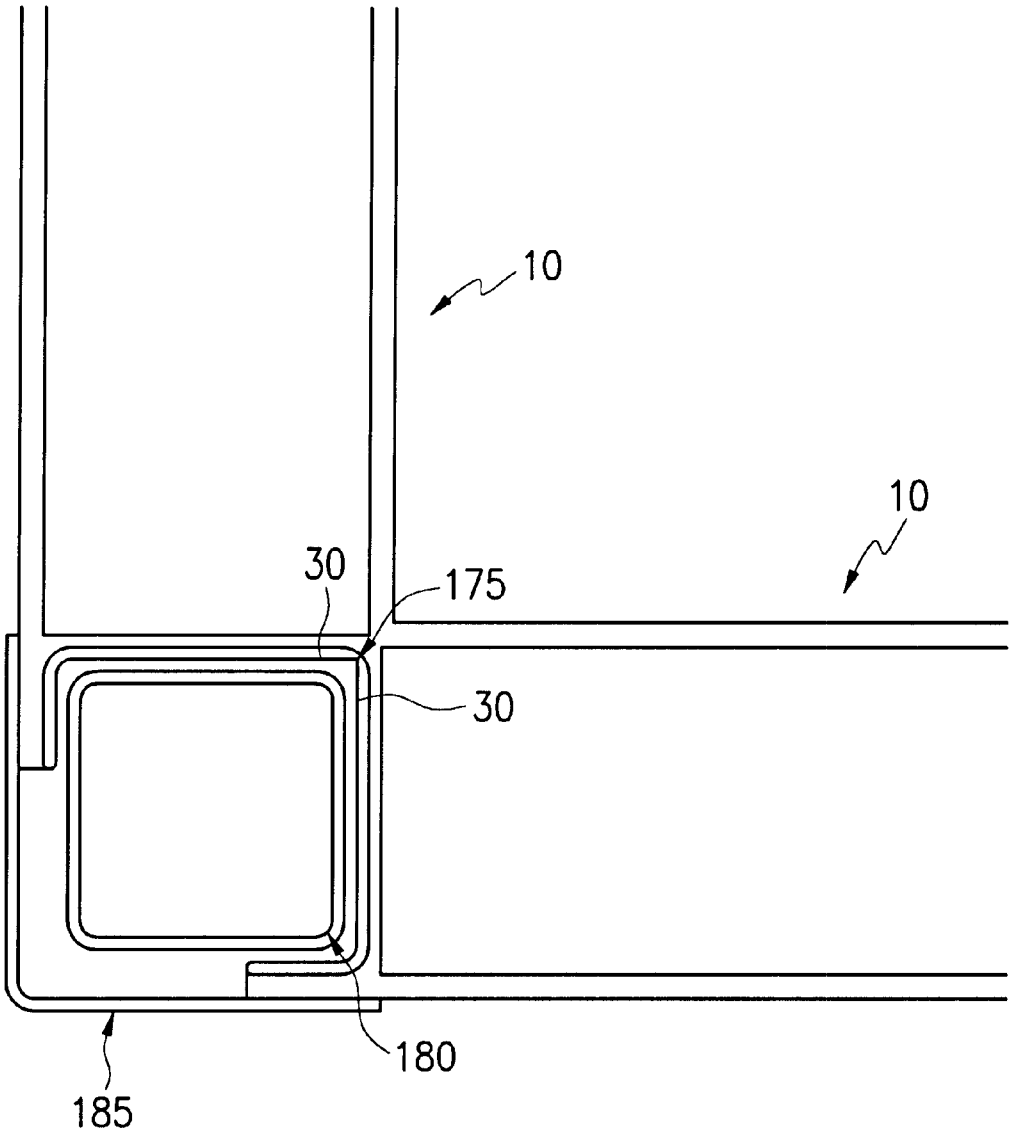
FIG. 9 is a top view of a corner joining two walls constructed with the OSB wall panel of FIG. 1.

Referring to FIG. 9, two OSB wall panels 10 may be joined at angles to form corners of walls. To join wall panels 10 at a corner, the panels may be provided cut so that they can be joined to form a corner. The panels 10 also may be cut along a vertical edge of the C-channel 30 such that panels may be joined to form a flush joint 175 at that edge. A vertical tube 180, which is similar to vertical panel tube 155, is placed in the space between the cut C-channels 30 before joining the cut edges. To provide a visually pleasing and insulating seal between the panels at the joint, caulking or sealant may be provided along the joint 175. When the panels are joined, a decorative covering 185 is wrapped around the outside of the corner and attached to the panels. The covering 185 may be a material; such as vinyl, and may be screwed or pop-riveted into place against the panels 10.

Figure 10:
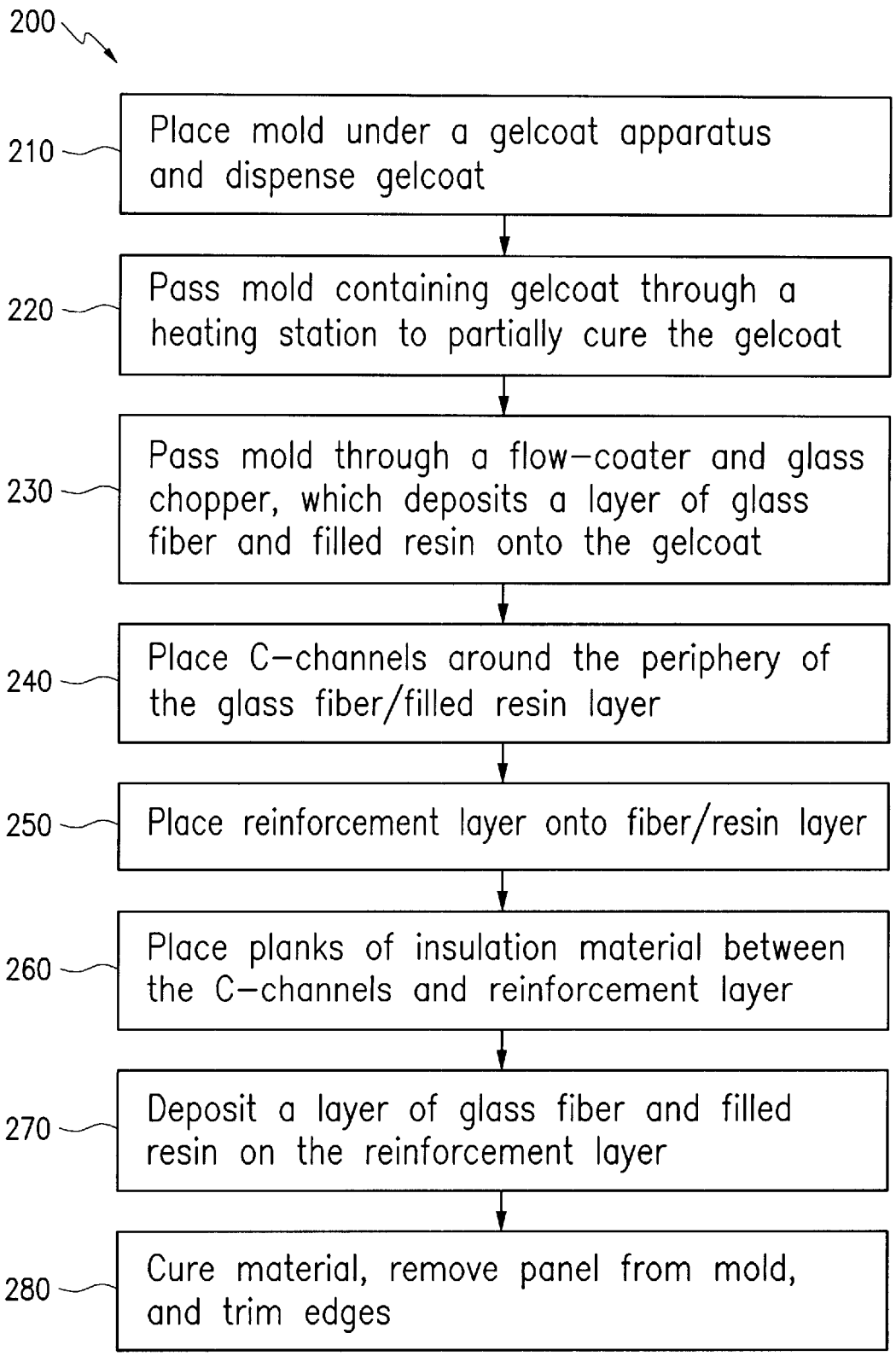
FIG. 10 is a flow chart showing the process steps for fabricating the OSB wall panel of FIG. 1.

The panels 10 are fabricated in a multi-step process 200, shown in the flow chart of FIG. 10. Initially, a mold is placed under a gel coat dispensing apparatus and gel coat is dispensed into the mold (step 210) to form the gel coat layer 50. Typically, the gel coat material will be dispensed to form a layer approximately 12 thousands to 20 thousands of an inch thick. The mold then is passed into a heating station in which heat is applied to partially cure the gel coat (step 220). The mold then is passed from the heating station into a flow-coater and glass chopper that deposits a layer of glass fiber and filled resin onto the partially cured gel coat (step 230) to form the outer skin layer 55. While the resin is still in a liquid form, the C-channels 30 are placed around the periphery of the fiber/resin layer with the opening facing outwardly (step 240). Then, the individual pieces of the reinforcement layer 60 are placed onto the fiber/resin layer (step 250) and the insulation material 70 is placed between the C-channels and reinforcement layer (step 260). Because a portion of each individual piece of the reinforcement layer covers an adjacent plank of insulation, adjacent reinforcement pieces and individual planks of the insulation may be placed on the fiber/resin layer in an alternating manner. Thus, steps 250 and 260 may be repeated a number of times to place the reinforcement and insulation layers. The partially completed panel then is moved into a flow-coater and glass chopper that deposits another layer of glass fiber and filled resin on the reinforcement layer (step 270) to form the inner, second skin layer 65 (step 270). Optionally, a second gel coat layer may be applied above the inner, second skin layer 65 so that both side of the wall panel 10 are textured and have a gel coat layer. Finally, once all the materials of the panel are in place, to cure the materials a heated aluminum or nylon cover is placed over the panel, a vacuum is applied through the cover, and bottom heaters are activated. When the material is cured, the panel is removed from the mold, and the edges are trimmed (step 280).

Variations of the fabrication process 200 are possible. For example, because the panel 100 (FIG. 6) does not include the inner skin layer 65, step 270 can be omitted. The mold into which the gel coat is dispensed also may be textured to have the negative of the texture that is imparted on the gel coat layer and outer skin layer 55. This texture can resemble a variety of materials, such as stone, slate, brick, wood, or marble. The reinforcement layer 60 is not necessary in all applications, thus, step 250 can be omitted in some instances. Depending on the strength requirements of the panel being produced, the quantity and proportions of resin and chopped glass used to make the skin layers 55 and 65 can varied to customize the strength.

Other features and advantages of the invention will be apparent from the following detailed description, including the drawings, and from the claims.

What is claimed is:

1. A wall panel comprising:

an outer surface layer having an outer surface, an inner surface, and outer edges;

an oriented strand board layer having an outer surface, an inner surface, and outer edges, with the outer surface of the oriented strand board layer attached to the inner surface of the outer surface layer; and mounting channels defined along and between the outer edges of the outer surface layer, and defining a region recessed from the edges of the outer surface layer, wherein the outer surface layer comprises an outer gel coat layer and an inner skin layer.

2. The wall panel of claim 1 wherein the outer gel coat layer comprises a gel coat material.

3. The wall panel of claim 2, wherein the gel coat material comprises a white gel coat material.

4. The wall panel of claim 3, wherein the gel coat material further comprises a dye.

5. The wall panel of claim 1, wherein the outer gel coat layer includes a textured outer surface.

6. The wall panel of claim 5, wherein the textured outer surface comprises a marble texture.

7. The wall panel of claim 5, wherein the textured outer surface comprises a stone texture.

8. The wall panel of claim 5, wherein the textured outer surface comprises a brick texture.

9. The wall panel of claim 5, wherein the textured outer surface comprises a wood texture.

10. The wall panel of claim 1, wherein the inner skin layer comprises glass fiber and resin.

11. The wall panel of claim 10, wherein the glass fiber is provided in a range of between approximately 2.0 and 5.0 ounces of glass fiber per square foot and the resin is provided in a range of between approximately 6.0 and 14.0 ounces of resin per square foot.

12. The wall panel of claim 1, wherein the outer layer further comprises a reinforcing layer adjacent to the oriented strand board layer.

13. The wall panel of claim 12, wherein the reinforcing layer comprises glass fibers and resin.

14. The wall panel of claim 12, wherein the reinforcing layer comprises at least one reinforcing rib.

15. The wall panel of claim 12, wherein the reinforcing layer is generally L-shaped, and includes a length section and a width section.

16. The wall panel of claim 15, wherein a length of the oriented strand board layer is adjacent to the length section of the reinforcing layer and a width of the oriented strand board layer is adjacent to the width section of the reinforcing layer.

17. The wall panel of claim 12, further comprising a second skin layer, wherein the second skin layer is adjacent to the oriented strand board layer.

18. The wall panel of claim 17, wherein the second skin layer comprises glass fiber and resin.

19. The wall panel of claim 18, wherein the second skin layer is textured.

20. The wall panel of claim 1, wherein the mounting channel is generally C-shaped.

21. The wall panel of claim 1, wherein the mounting channel comprises metal.

22. The wall panel of claim 1, further comprising a second skin layer, wherein the second skin layer is adjacent to the oriented strand board layer and comprises glass fiber and resin.

23. A wall panel comprising:

an outer surface layer having an outer surface, an inner surface, and outer edges;

an oriented strand board layer having an outer surface, an inner surface, and outer edges, with the outer surface of the oriented strand board layer attached to the inner surface of the outer surface layer; and mounting channels defined along and between the outer edges of the outer surface layer, and defining a region recessed from the edges of the outer surface layer, wherein the outer surface layer comprises an outer gel coat layer, a first inner skin layer, and a second skin layer, the outer gel coat layer including a textured outer surface and comprising a gel coat material including a dye, and the first inner skin layer and the second skin layer comprising glass fibers and resin.

24. The wall panel of claim 23 wherein the mounting channel is generally C-shaped.

25. The wall panel of claim 23 wherein the second skin layer is adjacent to the oriented strand board layer.

26. A wall panel comprising:

an outer surface layer having an outer surface, an inner surface, and outer edges;

an oriented strand board layer having an outer surface, an inner surface, and outer edges, with the outer surface of the oriented strand board layer attached to the inner surface of the outer surface layer; and mounting channels defined along and between the outer edges of the outer surface layer, and defining a region recessed from the edges of the outer surface layer, wherein the outer surface layer comprises an outer gel coat layer, an inner skin layer, and a reinforcing layer adjacent to the oriented strand board layer, the reinforcing layer comprising glass fibers and resin.

27. The wall panel of claim 26, further comprising a second skin layer, wherein the second skin layer is adjacent to the oriented strand board layer and comprises glass fiber and resin.

* * * * *

UNITED STATES PATENT AND TRADEMARK OFFICE

CERTIFICATE OF CORRECTION

PATENT NO. : 6,584,742 B1
DATED : July 1, 2003
INVENTOR(S) : Lennard J. Kligler et al.

It is certified that error appears in the above-identified patent and that said Letters Patent is hereby corrected as shown below:

Title page,
Item [63], replace "08/884,514, filed on Jun. 27, 1997" with -- 08/844,514, filed on Apr. 18, 1997 --
Item [60], please add as follows:
-- [60] Provisional application No. 60/015,602, filed on April 18, 1996. --

Column 1,
Line 7, replace "08/884,514, filed on June 27, 1997, now abandoned which is incorporated herein by reference in its entirety" with -- 884,514, filed April 18,1997 now abandoned, which claims priority from U.S. Provisional Application No. 60/015,602, filed April 18, 1996, both of which are incorporated herein by reference. --

Signed and Sealed this

Ninth Day of December, 2003

JAMES E. ROGAN
*Director of the United States Patent and Trademark Office*

UNITED STATES PATENT AND TRADEMARK OFFICE

CERTIFICATE OF CORRECTION

PATENT NO. : 6,584,742 B1
DATED : July 1, 2003
INVENTOR(S) : Lennard J. Kligler et al.

It is certified that error appears in the above-identified patent and that said Letters Patent is hereby corrected as shown below:

Title page,
Item [63], replace "08/884,514, filed on Jun. 27, 1997" with -- 08/844,514, filed on Apr. 18, 1997 --
Item [60], please add as follows:
-- [60] Provisional application No. 60/015,602, filed on April 18, 1996. --

Column 1,
Line 7, replace "08/884,514, filed on June 27, 1997, now abandoned which is incorporated herein by reference in its entirety" with -- 844,514, filed April 18,1997 now abandoned, which claims priority from U.S. Provisional Application No. 60/015,602, filed April 18, 1996, both of which are incorporated herein by reference. --

This certificate supersedes Certificate of Correction issued December 9, 2003.

Signed and Sealed this

Sixth Day of April, 2004

JON W. DUDAS
*Acting Director of the United States Patent and Trademark Office*